US005700985A

United States Patent [19]

Fischer et al.

[11] Patent Number: 5,700,985

[45] Date of Patent: Dec. 23, 1997

[54] INTERLOCK LATCH FOR ELECTRICAL OPERATOR

[75] Inventors: Kenneth M. Fischer, Finleyville; Craig J. Puhalla, Coraopolis, both of Pa.

[73] Assignee: Eaton Corporation, Cleveland, Ohio

[21] Appl. No.: 608,803

[22] Filed: Feb. 29, 1996

[51] Int. Cl.[6] ..... H01H 9/20

[52] U.S. Cl. ..... 200/50.01; 200/50.02; 200/50.12

[58] Field of Search ..... 200/50.01–50.04, 200/318.1–327, 329–345

[56] References Cited

U.S. PATENT DOCUMENTS

| | | | |
|---|---|---|---|
| 4,827,369 | 5/1989 | Saletta et al. | 361/96 |
| 4,951,020 | 8/1990 | Changle et al. | 335/167 |
| 4,963,846 | 10/1990 | Grunert et al. | 335/42 |
| 5,196,658 | 3/1993 | Gula | 200/50.32 |

OTHER PUBLICATIONS

Westinghouse Electric Corporation, *Installation Instructions for Motor Operator for R–Frame Circuit Breakers and Molded Case Switches*, I.L. 29C205–A, pp. 1–6, Apr. 1991.

*Primary Examiner*—J. R. Scott

*Attorney, Agent, or Firm*—Martin J. Moran

[57] ABSTRACT

An electrical operator includes a housing; a motor driven ball screw for operating the handle of a circuit breaker in an electrical mode of operation, and a handle extension for operating the circuit breaker handle in a manual mode of operation; a slider plate sliding through an opening of the housing between an intermediate position enabling the manual mode of operation, an inner position enabling the electrical mode of operation, and an outer position wherein the manual and electrical modes are disabled; and a cantilevered latch spring member connected to the slider plate. The free end of the cantilevered latch spring member engages the housing at about the opening thereof to stop the slider plate in its manual intermediate position. The free end of the cantilevered latch spring member deflects toward the slider plate to disengage from the housing and permit the slider plate to enter the inner electrical position thereof.

19 Claims, 5 Drawing Sheets

INTERLOCK LATCH FOR ELECTRICAL OPERATOR

BACKGROUND OF THE INVENTION

1. Field of the Invention

This invention is directed to an electrical operator for an electrical switching device and, more particularly, to such an electrical operator including an electrical mode and a manual mode of operation.

2. Background Information

Electrical operators are well-known in the art. An example is disclosed in U.S. Pat. No. 5,196,658. An electrical operator operates an electrical switching device, such as a circuit breaker, in electrical and manual modes of operation. In the electrical mode, a typical electrical operator, such as a motor operator, employs "on" and "off" electrical signals to control the forward and reverse operation of a reversible motor connected to a ball screw mechanism. The ball screw mechanism, in turn, typically drives a handle of the circuit breaker between its on and off positions. In the manual mode, a mechanism, such as a manual rotary crank, is employed by a user to engage the ball screw and manually move the circuit breaker handle between its on and off positions.

Circuit breakers are generally old and well-known in the art. Examples of circuit breakers are disclosed in U.S. Pat. Nos. 4,827,369; 4,951,020; and 4,963,846. Such circuit breakers are used to protect electrical circuitry from damage due to an overcurrent condition, such as an overload and relatively high level short circuit condition. Molded case circuit breakers, for example, include at least one pair of separable contacts which may be operated either manually by way of the circuit breaker handle disposed on the outside of the case or automatically in response to an overcurrent condition.

In some applications, a significant external operating force is required to "manually" move the circuit breaker handle between its on and off positions. The electrical motor or the manual mechanism of the electrical operator are employed to provide a suitable operating force to externally control the circuit breaker handle.

It is known to employ an electrical interlock, such as a limit switch, in combination with a mode selector mechanism, such as a selector plate or selector bar, to inhibit the electrical mode of the electrical operator. It is also known to employ a locking mechanism, such as a locking bar, a locking selector bar or a portion of the selector plate, to physically prevent movement of the circuit breaker handle from its off position to its on position.

It is further known to employ a sliding mode selector to engage or disengage a limit switch to respectively enable or disable the electrical mode. It is also known to employ a pin mechanism to latch the sliding mode selector in a first position, in which the limit switch is engaged, or to latch the sliding mode selector in a second position, in which the limit switch is disengaged by the selector. Whenever the pin mechanism unlatches the sliding mode selector in the second position with the electrical mode disabled, the mode selector is pivotable 90 degrees to a locking position which physically prevents movement of the circuit breaker handle from its off position.

It is also known to employ a handle extension mechanism for a circuit breaker handle in combination with an electrical operator.

SUMMARY OF THE INVENTION

The invention is directed to an electrical operator including a housing; operating means for operating a switching means of an electrical switching device in a first mode of operation and a second mode of operation; slider means for sliding with respect to the housing between a first position enabling the first mode of operation, and a second position enabling the second mode of operation of the operating means; and cantilevered latch spring means cooperating with the slider means, the cantilevered latch spring means stopping the slider means with respect to the housing in the second position of the slider means and deflecting toward the slider means to permit the slider means to enter the first position thereof, thereby permitting entry into the first mode of operation of the operating means.

As another aspect of the invention, an electrical operator includes a housing having an opening; means for operating switching means of an electrical switching device including a first position corresponding to the on position of the switching means and a second position corresponding to the off position of the switching means; means for controlling the means for operating the switching means in a first mode of operation of the electrical operator; means for controlling the switching means in a second mode of operation of the electrical operator; selecting means protruding through the opening of the housing, for selecting the first and second modes of operation, including at least a first position enabling the first mode of operation and a second position enabling the second mode of operation; and latch means, cooperating with the selecting means, including means for engaging the housing at about the opening thereof in the second position of the selecting means and means for disengaging the means for engaging the housing from the housing to enter the first position of the selecting means.

BRIEF DESCRIPTION OF THE DRAWINGS

A full understanding of the invention can be gained from the following description of the preferred embodiments when read in conjunction with the accompanying drawing in which.

DESCRIPTION OF THE PREFERRED EMBODIMENT

Figure 1:
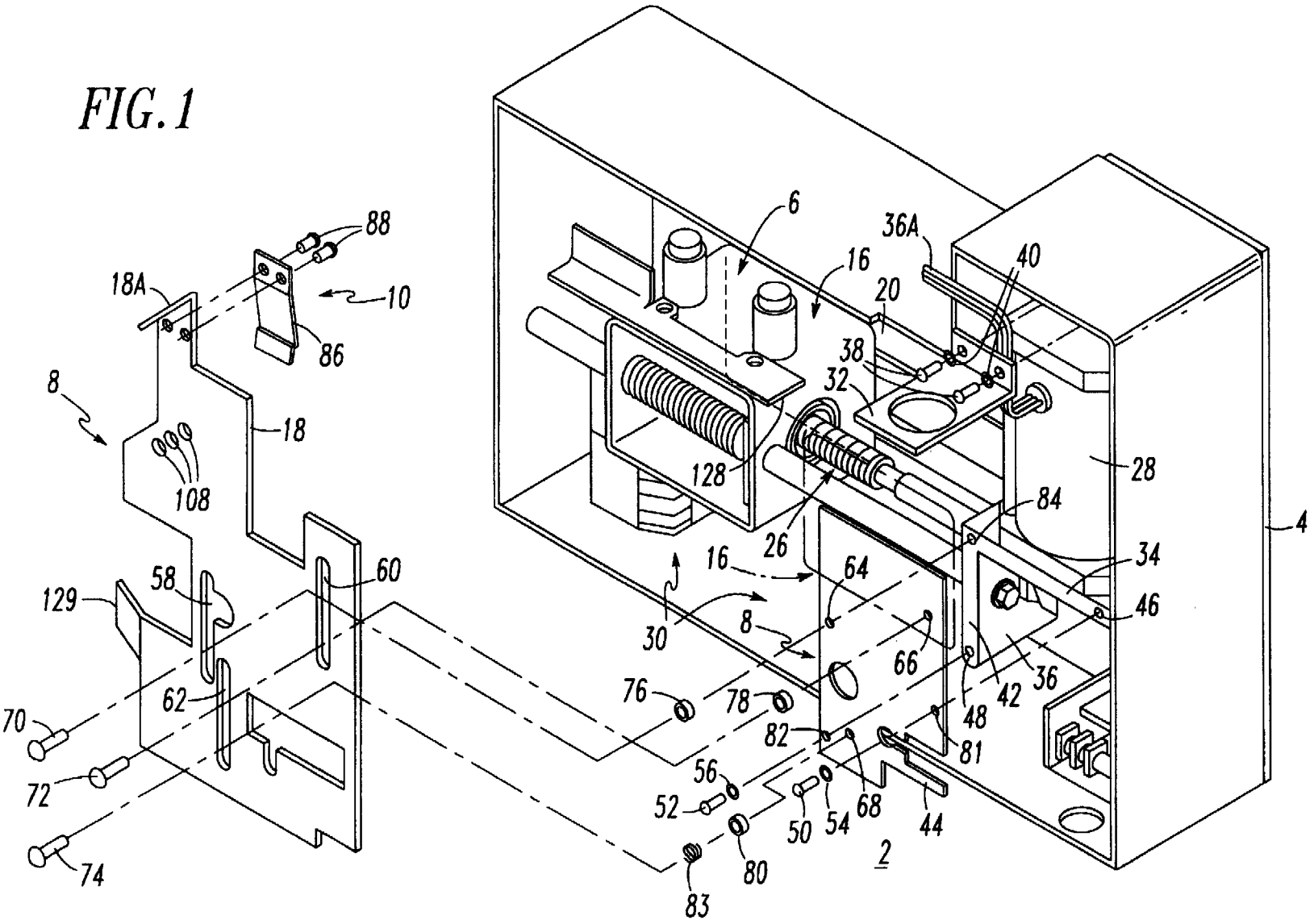
FIG. 1 Is an exploded isometric view, with some parts not shown for clarity, of an electrical operator including a mechanism for engaging a circuit breaker handle, a slider plate and an interlock latch in accordance with the invention.

FIG. 1 illustrates a motor or electrical operator 2 including a base 4, an operating mechanism 6, a selecting mechanism 8 and an interlock latch 10. As discussed below in connection with FIGS. 4 and 5, the operating mechanism 6 operates a switching mechanism, such as a handle 14 (shown in phantom line drawing in FIG. 5), of an electrical switching device, such as a circuit breaker 120 (shown in phantom line drawing in FIG. 4), in a manual mode of operation and a motordriven electrical mode of operation. As shown in FIG. 5, the operating mechanism 6 includes an extension mechanism 12 for engaging and controlling the circuit breaker handle 14 in the manual mode. The operating mechanism 6 also includes a handle actuator assembly 16 for operating the handle 14 in the electrical mode. The handle actuator assembly 16 is moved by the operating mechanism 6 between a position (shown in solid in FIG. 1) corresponding to the off position of the circuit breaker handle 14 and another position (shown in phantom line drawing toward the lower fight of FIG. 1) corresponding to the on position of the handle 14.

Figure 4:
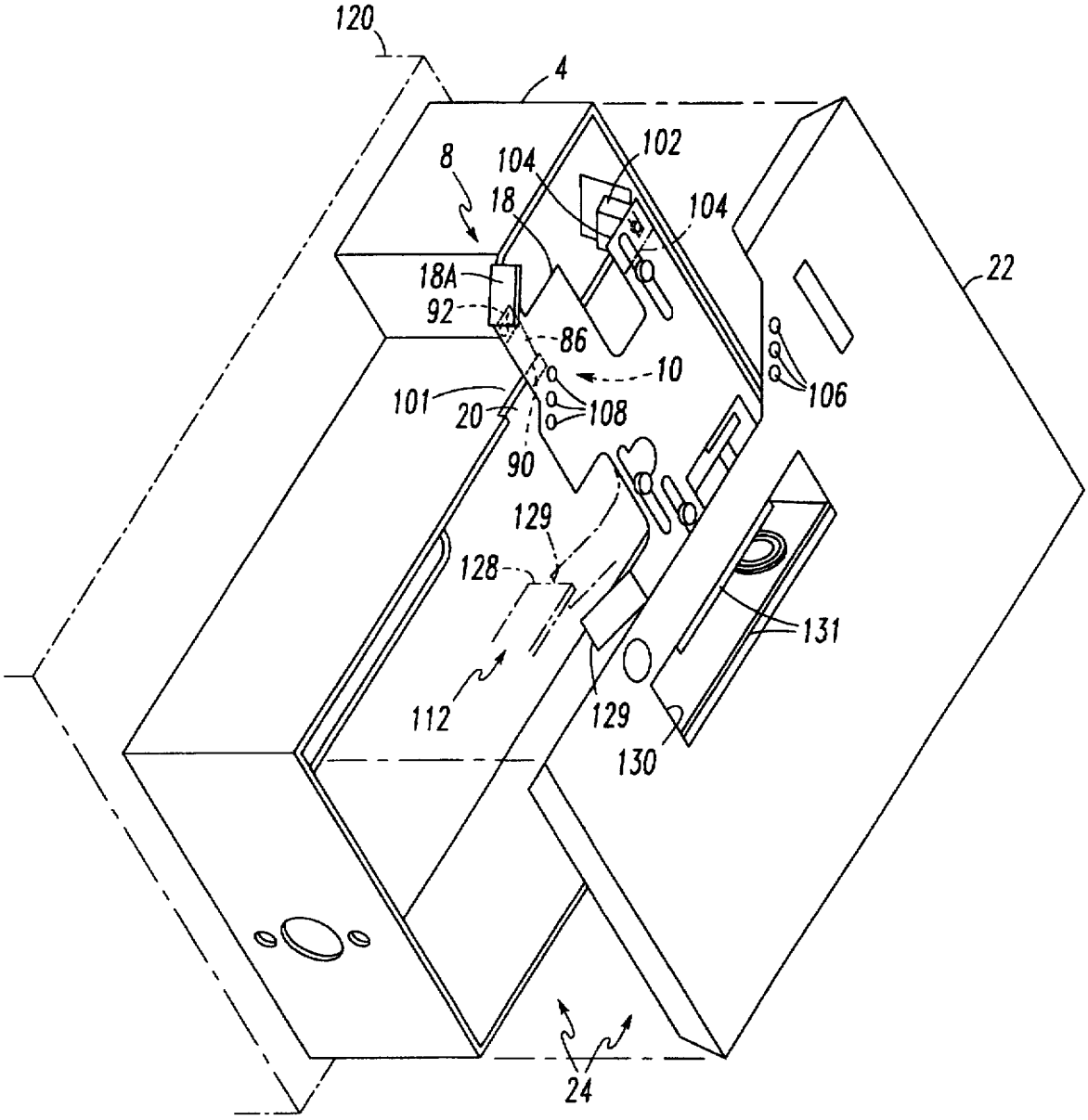
FIG. 4 is an exploded isometric view, with some parts not shown for clarity, of the electrical operator of FIG. 1 including a removable cover with the slider plate and interlock latch in an interlocked position.
Figure 5:
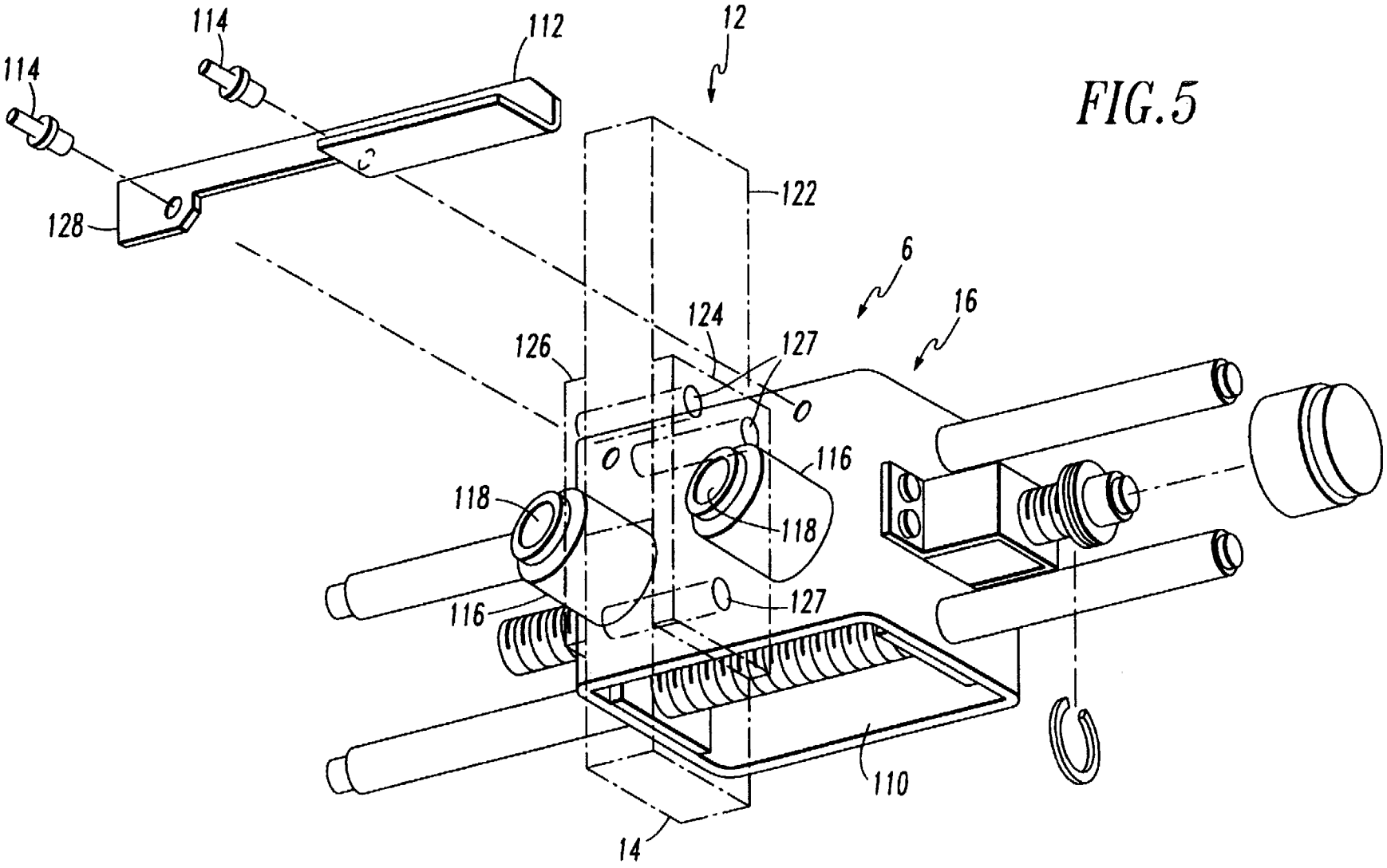
FIG. 5 is a partially exploded isometric view of the mechanism of FIG. 1 for engaging a circuit breaker handle.

Referring to FIG. 4, the selecting mechanism 8 includes a slider plate 18 which protrudes through an opening 20 formed between a removable cover 22 and the base 4. The cover 22 and base 4 are connected by fasteners (not shown) and form a housing 24. The selecting mechanism 8 is slidable by way of a push-pull member 18A between an intermediate position at 104 (shown in solid) which enables the manual mode, an inner position at phantom 104 (shown in phantom line drawing toward the bottom fight of FIG. 4) which enables the electrical mode, and an outer position in which the manual and electrical modes of operation are both disabled. The interlock latch 10 (shown in hidden line drawing) cooperates with the selecting mechanism 8 and engages the base 4 of the housing 24 at about the opening 20 in the intermediate or manual position of the selecting mechanism 8.

Referring again to FIG. 1, the operating mechanism 6 further includes a ball screw 26 driven by a reversible motor 28 and an electric control circuit 30 which energizes the motor 28. The base 4, ball screw 26, motor 28, control circuit 30 and the electrical mode of the operating mechanism 6 are disclosed in U.S. Pat. No. 5,196,658 which is incorporated by reference herein. Except as disclosed below in connection with FIGS. 4 and 5, the handle actuator assembly 16 is substantially the same as with the disclosure of U.S. Pat. No. 5,196,658.

The control circuit 30 controls the motor 28 which, in turn, controls the position of the handle actuator assembly 16 and, hence, the position of the circuit breaker handle 14 of FIG. 5 in the electrical mode. One end of the motor 28 is mounted to the base 4 by a motor mounting bracket 32. The other end of the motor 28 is mounted to a leg 34 of an L-shaped bracket 36 suitably attached to the base 4. The motor 28 is selectively energized in either a forward or a reverse direction by the control circuit 30 through conductors 36A. The motor mounting bracket 32 is attached to the base 4 by a pair of screws 38 and a pair of lock washers 40. The other leg 42 of the L-shaped bracket 36 provides suitable support for the ball screw 26 and the handle actuator assembly 16.

The selecting mechanism 8 includes the slider plate 18 and a bracket or base plate 44. The base plate 44 is secured to the L-shaped bracket 36 at two threaded holes 46,48 by screws 50,52 and lock washers 54,56, respectively. The slider plate 18, in turn, is slidably supported by the base plate 44 in the following manner. The slider plate 18 has three generally straight elongated openings 58,60,62 which correspond to three holes 64,66,68, respectively, of the base plate 44. Three screws 70,72,74 are inserted through the openings 58,60,62, through three slider studs 76,78,80, and then through the three holes 64,66,68, respectively, of the base plate 44. The holes 66,68 are threaded to retain the screws 72,74, respectively. The holes 81,82 of the base plate 44 accept the screws 50,52, respectively. A slider spring 83 is positioned about the screw 74 between the slider plate 18 and the slider stud 80. The screw 70 is threaded into a third threaded hole 84 of the L-shaped bracket 36. In this manner, the slider plate 18 is generally slidable in a plane defined by the base 4 and the base plate 44, and between the three positions discussed above in connection with FIG. 4.

Figure 2:
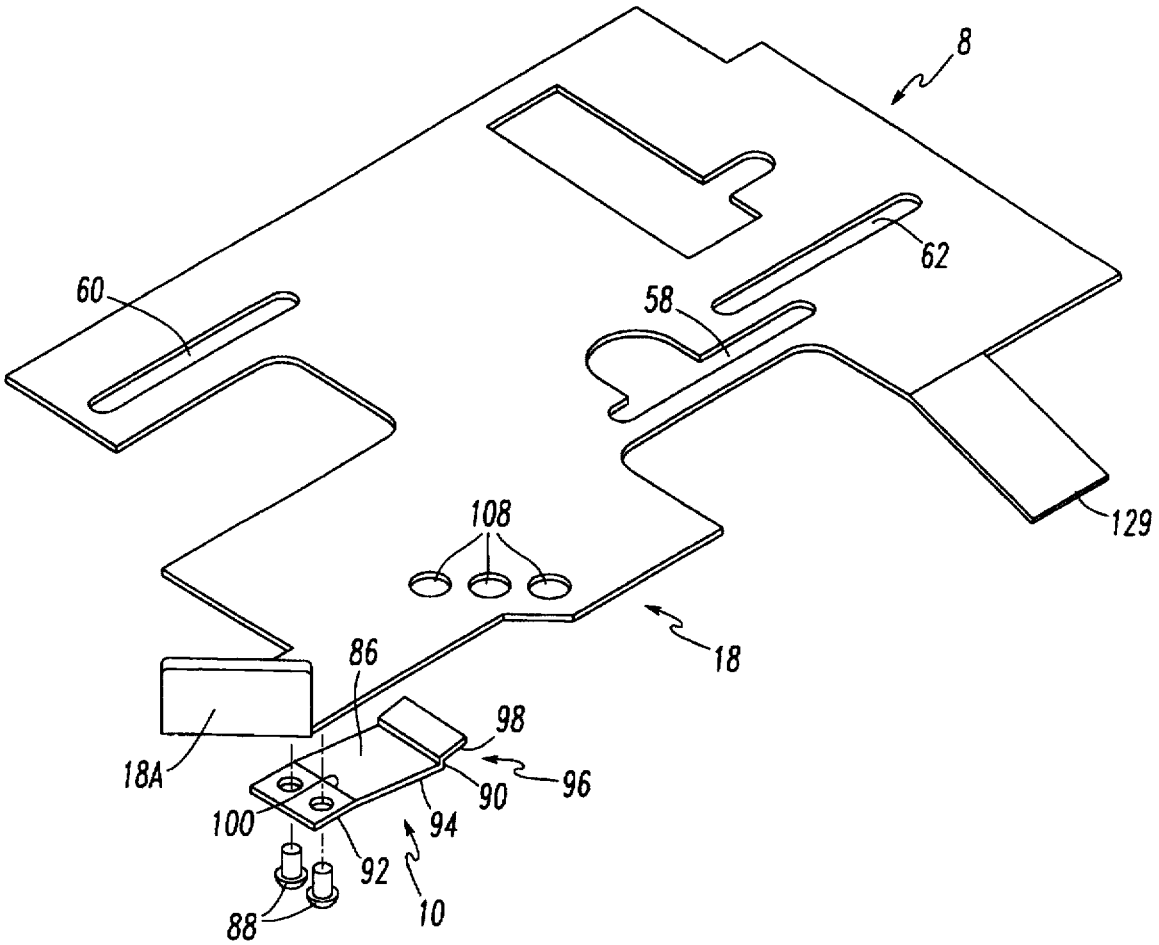
FIG. 2 is an exploded isometric view of the slider plate and interlock latch of FIG. 1.

Referring to FIG. 2, the slider plate 18 and the interlock latch 10 are illustrated. The exemplary interlock latch 10 includes a cantilevered latch spring member 86 suitably secured to the slider plate 18 by fasteners 88, such as pop rivets or semi-pierce members. The latch member 86 (shown in hidden line drawing in FIG. 4) engages the base 4 to stop the slider plate 18 (shown in solid) from moving toward the bottom right of FIG. 4, thereby preventing entry into the electrical mode from the manual mode.

Figure 3:
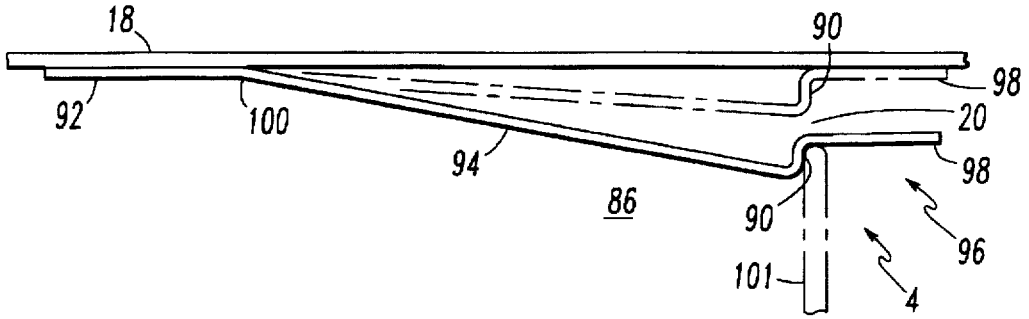
FIG. 3 is a side view of the interlock latch and a portion of the slider plate of FIG. 1.

Also referring to FIG. 3, the member 86 has a surface 90 which engages the base 4 at about the opening 20, thereby preventing the slider plate 18 from entering the electrical position. Whenever the member 86 is deflected (as shown in phantom line drawing in FIG. 3) toward the slider plate 18, the surface 90 disengages from the base 4, thereby permitting the slider plate 18 to enter the electrical position.

Continuing to refer to FIGS. 2 and 3, the cantilevered latch spring member 86 has a first portion 92 connected to the slider plate 18, a second portion 94 for engagement by a user, and a third portion 96 including the surfaces 90,98 for engaging the base 4 at about the opening 20 thereof in the manual position of the slider plate 18. In this manner, one end of the member 86 at portion 92 is cantilevered from the slider plate 18 and the other end of the member 86 at portion 96 engages the base 4 to stop the slider plate 18 in the manual position. Preferably, the surface 98 of the slider plate 18 engages (not shown) the base 4 at about the opening 20 thereof in the outer disabled position of the slider plate 18.

The user engages the second portion 94 of the member 86 to disengage the third portion 96 from the base 4 to permit the slider plate 18 to enter the inner electrical position. The member 86 has a resilient bend 100 between the first and second portions 92,94 to permit the first and second portions 92,94 to be about aligned with the slider plate 18 after the user engages the second portion 94, thereby causing the surface 90 to disengage from the base 4. After the user disengages the second portion 94, the resilient bend 100 permits the second and third portions 94,96 of the member 86 to return to their original position (shown in solid in FIG. 3).

Referring to FIG. 4, the base 4, slider plate 18, cantilevered latch spring member 86 (shown in hidden line drawing) and removable cover 22 are illustrated. The first portion 92 of the member 86 is generally normal to a surface 101 of the base 4 at about the opening 20 thereof. The surface 90 of the member 86 is about parallel to the surface 101 of the base 4. In the intermediate manual position (shown in solid) and in the outer disabled position (shown in phantom line drawing toward the upper left of FIG. 4), a limit switch 102 is engaged by a portion 104 of the slider plate 18 to disable the motor 28 of FIG. 1. On the other hand, in the inner electrical position (shown in phantom line drawing toward the bottom right of FIG. 4), the limit switch 102 is not engaged by portion 104, thereby permitting the motor 28 to be operated under the control of the electrical control circuit 30 of FIG. 1. In the outer disabled position of the slider plate 18, the holes 106 of the cover 22 align with the holes 108 of the slider plate 18 to permit the slider plate 18 to be locked in place with a padlock (not shown).

Also referring to FIG. 5, the handle actuator assembly 16 includes a frame 110 and a stop member 112 suitably attached thereto with fasteners 114. Rotatably mounted to the frame 110 are a pair of rollers 116 rotatably secured thereto by fasteners 118. Disposed between the rollers 116 is the extension mechanism 12 which engages and controls the handle 14 of the circuit breaker 120 (shown in phantom line drawing in FIG. 4) in the manual mode. A typical molded case circuit breaker suitable for use with the electrical operator 2 of FIG. 1 is disclosed in U.S. Pat. No. 4,951,020 which is incorporated by reference herein, although the invention is applicable to a wide variety of electrical switching devices.

The extension mechanism 12 includes an extension member 122, which is aligned with the handle 14, and two mounting plates 124,126, which are secured on opposite sides of the member 122 and handle 14 by fasteners 127. The mounting plates 124,126 engage the circuit breaker handle 14 and the extension member 122 and extend the handle 14 to provide suitable leverage for operation by the user between an exemplary off position (toward the bottom left of FIG. 4) and an exemplary on position (toward the upper right of FIG. 4), although the invention is applicable to any mechanism for manual operation (e.g., a handle crank assembly as disclosed in U.S. Pat. No. 5,196,658). The rollers 116 engage the mounting plates 124,126 at the handle 14 in a similar manner as the rollers engage the handle extension at the handle of U.S. Pat. No. 5,196,658.

Still referring to FIG. 4, in the manual and the electrical positions of the slider plate 18, the circuit breaker handle 14 is operable between the on and off positions thereof by the extension mechanism 12 and the handle actuator assembly 16 as discussed above in connection with FIG. 5. However, in the disabled position of the slider plate 18, movement of the handle 14 from the off position to the on position is disabled. An end 128 (shown in phantom line drawing) of the stop member 112 of the handle actuator assembly 16 of FIG. 5 engages a flange portion 129 (shown in phantom line drawing) extending downwardly from the slider plate 18 in its disabled position, thereby preventing movement of the handle actuator assembly 16. In this manner, the handle 14 is held in its off position by the handle actuator assembly 16, thereby preventing movement of the handle 14 in the disabled position of the slider plate 18. On the other hand, in either the manual or the electrical positions of the slider plate 18, the stop member 112 of the handle actuator assembly 16 does not engage the flange portion 129, thereby permitting movement of the handle 14 under the influence of either the extension mechanism 12 or the handle actuator assembly 16.

Figure 6:
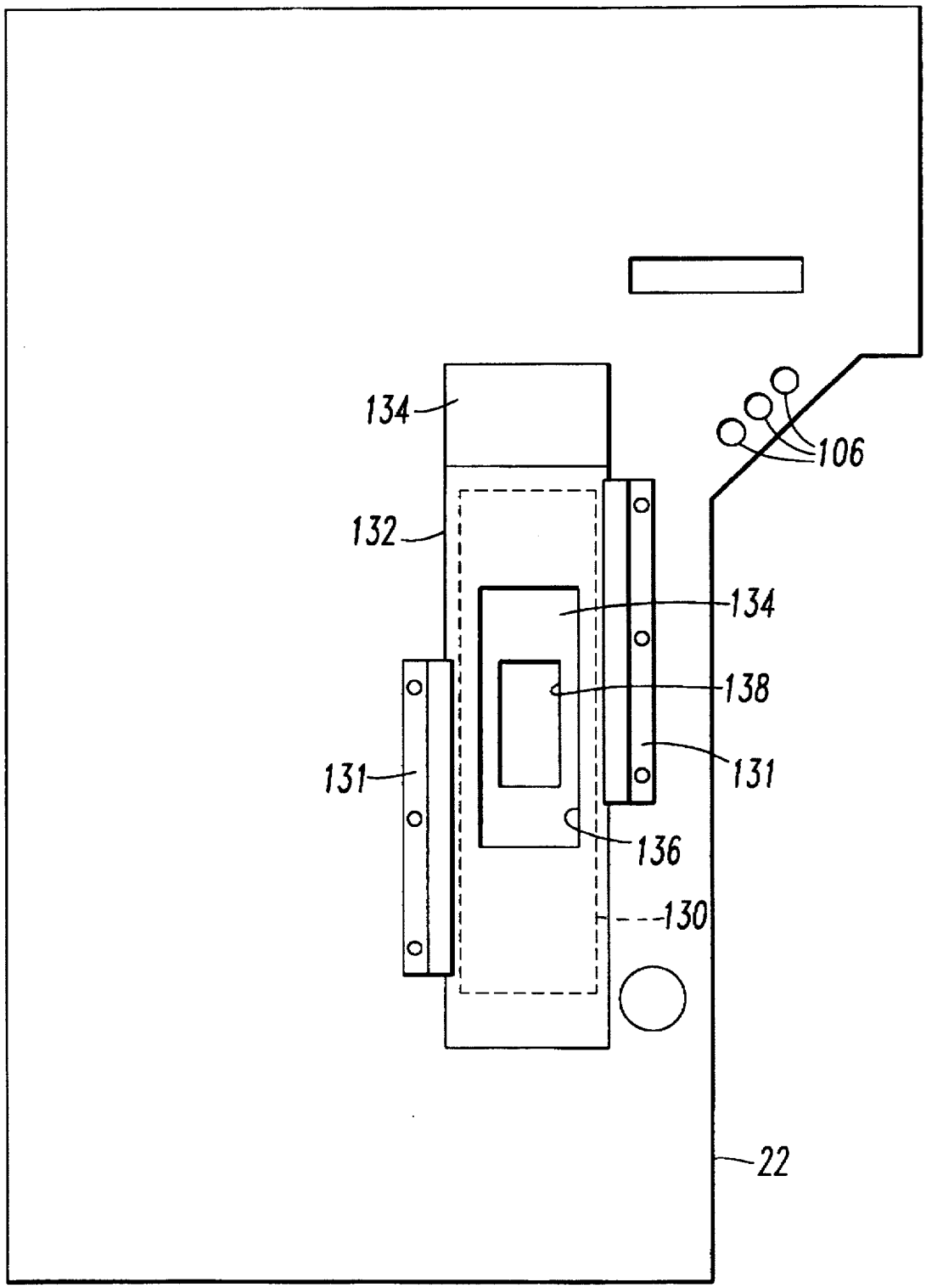
FIG. 6 is a bottom view of the removable cover of FIG. 4.

FIG. 6 illustrates a bottom view of the removable cover 22 for the base 4 of FIG. 1. The cover 22 is similar to the disclosure of U.S. Pat. No. 5,196,658 except that an opening 130 (shown in hidden line drawing in FIG. 6) is provided for the circuit breaker handle 14 of FIG. 5. Suitably attached to the rear of the cover 22 are a pair of channels 131 which hold handle sliders 132,134. The handle sliders 132,134 include holes 136,138, respectively, through which the circuit breaker handle 14 passes for operation by the user at the front of the cover 22.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An electrical operator for an electrical switching device including switching means for switching said electrical switching device, said electrical operator comprising:

a housing;

operating means for operating said switching means in a first mode of operation and a second mode of operation;

slider means for sliding with respect to said housing between a first position enabling the first mode of operation, and a second position enabling the second mode of operation of said operating means; and cantilevered latch spring means cooperating with said slider means, said cantilevered latch spring means for stopping said slider means with respect to said housing in the second position of said slider means, said cantilevered latch spring means deflecting toward said slider means to permit said slider means to enter the first position thereof, thereby permitting entry into the first mode of operation of the operating means.

2. The electrical operator as recited in claim 1 wherein said slider means further includes a third position in which the first and second modes of operation are disabled.

3. The electrical operator as recited in claim 1 wherein said cantilevered latch spring means has a first portion connected to said slider means, a second portion for engagement by a user, and a third portion engaging said housing in the second position of said slider means.

4. The electrical operator as recited in claim 3 wherein the user engages the second portion of said cantilevered latch spring means to disengage the third portion of said cantilevered latch spring means from said housing to permit said slider means to enter the first position thereof.

5. The electrical operator as recited in claim 4 wherein said housing has a surface; wherein the first portion of said cantilevered latch spring means is generally normal to the surface of said housing; wherein said cantilevered latch spring means further has a bend between the first and second portions thereof; and wherein the third portion of said cantilevered latch spring means has a surface which is substantially parallel to the surface of said housing.

6. The electrical operator as recited in claim 5 wherein the bend is a resilient bend to permit said first and second portions is to be substantially aligned after the user engages said second portion, and to permit the third portion of said cantilevered latch spring means to return to its original position after the user disengages said second portion.

7. The electrical operator as recited in claim 1 wherein said housing has an opening; wherein said slider means protrudes through the opening of said, housing; wherein said cantilevered latch spring means includes means for engaging said housing substantially at said opening thereof in the second position of said slider means, and means for disengaging said means for engaging said housing from said housing to enter the first position of said slider means.

8. The electrical operator as recited in claim 1 wherein the first mode of operation is an electrical mode; wherein the second mode of operation is a manual mode; and wherein said cantilevered latch spring means engages said housing to prevent entry into the electrical mode from the manual mode.

9. The electrical operator as recited in claim 8 wherein said switching means is a circuit breaker handle; wherein said operating means includes means extending the circuit breaker handle for operation by a user in the manual mode and motor means for operating the circuit breaker handle in the electrical mode.

10. The electrical operator as recited in claim 1 wherein said cantilevered latch spring means has a first end and a second end; wherein the first end of said cantilevered latch spring means is cantilevered from said slider means; and wherein the second end of said cantilevered latch spring means engages said housing to stop said slider means in the second position thereof.

11. An electrical operator for an electrical switching device including switching means for switching said electrical switching device, said switching means having an on position and an off position, said electrical operator comprising:

a housing having an opening;

means for operating said switching means including a first position corresponding to the on position of said switching means and a second position corresponding to the off position of said switching means;

means for controlling said means for operating said switching means in a first mode of operation of said electrical operator;

means for controlling said switching means of said electrical switching device in a second mode of operation of said electrical operator;

selecting means protruding through the opening of said housing for selecting the first and second modes of operation, said selecting means including at least a first position enabling the first mode of operation and a second position enabling the second mode of operation; and latch means cooperating with said selecting means, said latch means including means for engaging said housing at about the opening thereof in the second position of said selecting means and means for disengaging said means for engaging said housing from said housing to enter the first position of said selecting means.

12. The electrical operator as recited in claim 11 wherein said selecting means further includes a third position wherein the first and second modes of operation are disabled, and means for sliding between the first, second and third positions of said selecting means.

13. The electrical operator as recited in claim 11 wherein said selecting means further includes a slider member and means for sliding the slider member between the first and second positions of said selecting means; and wherein said latch means includes a member having a first portion connected to the slider member, a second portion for engagement by a user, and a third portion engaging said housing at about the opening thereof in the second position of said selecting means.

14. The electrical operator as recited in claim 13 wherein the user engages the second portion of the member to disengage the third portion of said member from said housing to permit said selecting means to enter the first position thereof.

15. The electrical operator as recited in claim 14 wherein said housing has a surface; wherein the first portion of the member is generally normal to the surface of said housing; wherein the member further has a bend between the first and second portions thereof; and wherein the third portion of the member has a surface about parallel to the surface of said housing.

16. The electrical operator as recited in claim 15 wherein the first and second portions of the member are substantially aligned when said means for engaging said housing disengages from said housing to enter the first position of said selecting means.

17. The electrical operator as recited in claim 16 wherein the bend is a resilient bend to permit said first and second portions to be substantially aligned after the user engages said second portion, and to permit the third portion of the member to return to its original position after the user disengages said second portion.

18. The electrical operator as recited in claim 11 wherein the first mode of operation is an electrical mode; wherein the second mode of operation is a manual mode; and wherein said means for engaging said housing engages said housing to prevent entry into the electrical mode from the manual mode.

19. The electrical operator as recited in claim 18 wherein said switching means is a circuit breaker handle; wherein said means for controlling said switching means includes means for engaging the circuit breaker handle; and wherein said means for operating said switching means includes means for engaging said means for engaging the circuit breaker handle.

* * * * *